US006161509A

United States Patent [19]

Dahlberg et al.

[11] Patent Number: 6,161,509

[45] Date of Patent: Dec. 19, 2000

[54] CYLINDER

[75] Inventors: Göran Dahlberg, Gränna; Magnus Fröjd, Huskvarna; Niels Hartz, Huskvarna; Ulf Näslund, Huskvarna, all of Sweden

[73] Assignee: Aktiebolaget Electrolux, Stockholm, Sweden

[21] Appl. No.: 09/155,814

[22] PCT Filed: Apr. 4, 1997

[86] PCT No.: PCT/SE97/00572

§ 371 Date: Dec. 14, 1998

§ 102(e) Date: Dec. 14, 1998

[87] PCT Pub. No.: WO97/38217

PCT Pub. Date: Oct. 16, 1997

[30] Foreign Application Priority Data

Apr. 4, 1996 [SE] Sweden ..... 9601313

[51] Int. Cl.[7] ..... F02B 33/28

[52] U.S. Cl. ..... 123/73 PP; 123/65 A

[58] Field of Search ..... 123/73 PP, 65 PE, 123/65 A, 65 P, 73 R, 184.22, 184.23

[56] References Cited

U.S. PATENT DOCUMENTS

| | | | |
|---|---|---|---|
| 4,121,552 | 10/1978 | Mithuo et al. | 123/65 PE |
| 4,287,860 | 9/1981 | Fujikawa et al. | 123/73 PP |
| 4,337,734 | 7/1982 | Iio | 123/65 PE |
| 4,353,333 | 10/1982 | Iio | 123/73 R |
| 4,607,598 | 8/1986 | Kamata | 123/55.7 |
| 4,736,716 | 4/1988 | Ohyama | 123/65 A |
| 5,025,760 | 6/1991 | Webb et al. | 123/73 PP |
| 5,251,580 | 10/1993 | Torigai | 123/65 P |
| 5,471,960 | 12/1995 | Nagao et al. | 123/65 A |
| 5,490,483 | 2/1996 | Tanikake et al. | 123/65 P |
| 5,870,981 | 2/1999 | Knaus et al. | 123/65 A |
| 5,881,687 | 3/1999 | Sakaguchi et al. | 123/65 R |
| 6,016,776 | 1/2000 | Jonsson | 123/65 A |

FOREIGN PATENT DOCUMENTS 2262199 10/1974 France .

*Primary Examiner*—Andrew M. Dolinar
*Assistant Examiner*—Hai Huynh
*Attorney, Agent, or Firm*—Pearne & Gordon LLP

[57] ABSTRACT

The invention refers to a cylinder (1) for a two-stroke internal combustion engine intended for a handheld working tool, preferably a chain saw, and the exhaust duct (2) and transfer ducts (3, 4) of the cylinder are symmetrically arranged around a mutual symmetry plane (5) which follows the centre line (6) of the cylinder, and at the mouth (7) of the exhaust duct (2) outside the cylinder, a mounting plane (8) with mounting holes (9) for a directly mounted muffler, is arranged.

According to the invention, at least one inlet port (11) is located in the cylinder wall (12) and/or in an adjacent crankcase half (10), and the cylinder's in let duct (13) up to the inlet port (11) is so arranged that it forms a fixed and heat-conducting part of the cylinder, and has a length longer than 0.8 times the diameter (14) of the cylinder, preferably longer than 10 times the diameter.

10 Claims, 2 Drawing Sheets

CYLINDER

TECHNICAL FIELD

The subject invention refers to a cylinder for a two-stroke combustion engine intended for a handheld working tool, preferably a chain saw, and the exhaust duct and transfer ducts of the cylinder are symmetrically arranged around a mutual symmetry plane which follows the centre line of the cylinder, and at the mouth of the exhaust duct outside the cylinder a mounting plane with mounting holes for a directly mounted muffler is arranged.

BACKGROUND OF THE INVENTION

Due to requirements of low weight and compact design portable working tools are usually run by a crankcase scavenged two-stroke engine. However, a crankcase scavenged four-stroke engine is also conceivable. As a result of the crankcase scavenging the engine is lubricated by oil in the fuel. This means that the tool can be used and managed in different directions during running, i.e. sideways or upside-down. The tools usually have a carburetor connected to an inlet duct, but also a low pressure injection system can be of interest. Since the tool can be used in a lot of positions there is a risk for fuel drops to accumulate inside the inlet duct and then be tipped into the cylinder when the tool's inclination is changed. This can bring about that the engine stops. The greatest risk for this is at lower engine speed. This has also brought about that the carburettor usually is placed near the inlet port, i.e. that the inlet duct is short. Considering engine power at operating speed it would however be preferable to use a longer inlet duct. This could however be associated with said difficulties as well as pure space problems. Therefore the carburetor usually is placed adjacent the cylinder's top section, and provided with some kind of heat protecting baffle. This baffle implies a complication at the same time as temperature problems can still arise for the carburettor. Furthermore, the inlet duct is usually turned obliquely down towards the crankcase. Owing to this the inlet gases can not assist in cooling the critical area around the exhaust port.

PURPOSE OF THE INVENTION

The purpose of the subject invention is to substantially reduce the above outlined problems.

SUMMARY OF THE INVENTION

The above mentioned purpose is achieved in a cylinder, in accordance with the invention, having the characteristics appearing from the appended claims.

The cylinder according to the invention is thus essentially characterized in that at least one inlet port is located in the cylinder wall and/or in an adjacent crankcase half, and that the cylinder's inlet duct towards the inlet port is so arranged that it forms a fixed and heat-conducting part of the cylinder, and has a length longer than 0.8 times the diameter of the cylinder, preferably longer than 1.0 times the diameter. Conditions are hereby created for having an extremely long inlet duct of the engine in the handheld working tool. The inlet duct of the cylinder is preheated and due to its large length conditions are created to connect a relatively long duct section upstreams towards the carburetor. For, this long preheated section vaporizes fuel drops very efficiently. Furthermore the location of the inlet port is creating conditions for an advantageous drawing of the engine's inlet duct and for cooling the area at the exhaust port. The working tool can thus have an engine with an extremely long inlet duct. This creates opportunities for increasing the engine's traction power at normal running speed, and can give higher power and/or cleaner exhaust gases at operating speed. For, owing to increased throttling on the exhaust side less exhaust emissions can be achieved with retained power, i.e. an advantage of power and/or emission. The reason for this improvement is that a higher engine charging efficiency can be obtained at the present engine speed. This is achieved due to a more favourable Helmholz resonance frequency. The resonance frequency is determined essentially by the relation between the length of the inlet duct and the crankcase volume, which is relatively well reflected by the cylinder diameter.

BRIEF DESCRIPTION OF THE DRAWING

The invention will be described in closer detail in the following by way of various embodiments thereof with reference to the accompanying drawing, in which the same numbers in the different figures state one another's corresponding parts.

In FIG. 1 numeral reference 1 designates a cylinder in accordance with the invention. The cylinder is seen in a longitudinal direction of the cylinder's crankshaft centre line 20. The cylinder has an axial extension with centre line 6 and is provided with a large number of cooling fins 23, 24 as it is intended for an air-cooled engine. The cooling fins 24 at the cylinder's top section, e.g. on top of the figure, are vertical. This means that their longitudinal extension is parallel with the cylinder's longitudinal extension, while the remaining cooling fins 23 have their extension essentially sideways. To the left of the figure the mouth 7 of the exhaust duct outside the engine is seen. It is embodied with a mounting plane 8 with mounting holes 9, which usually are threaded, for a directly mounted muffler. The cylinder is also provided with a mounting hole 22 for a support holder of the muffler. The muffler is thus secured by means of three screws in threaded holes 9, 22. However, it is conceivable that the holes might not be threaded. To the right in the figure the inlet duct 13 of the cylinder is seen. It is so designed that it forms a fixed and heat-conducting part of the cylinder and has an extremely large length. Hereby it can vaporize fuel drops to a great extent. The inlet duct 13 is produced by casting together with the other part of the cylinder. But it could also be made of a firmly mounted tube or similar.

Figure 2:
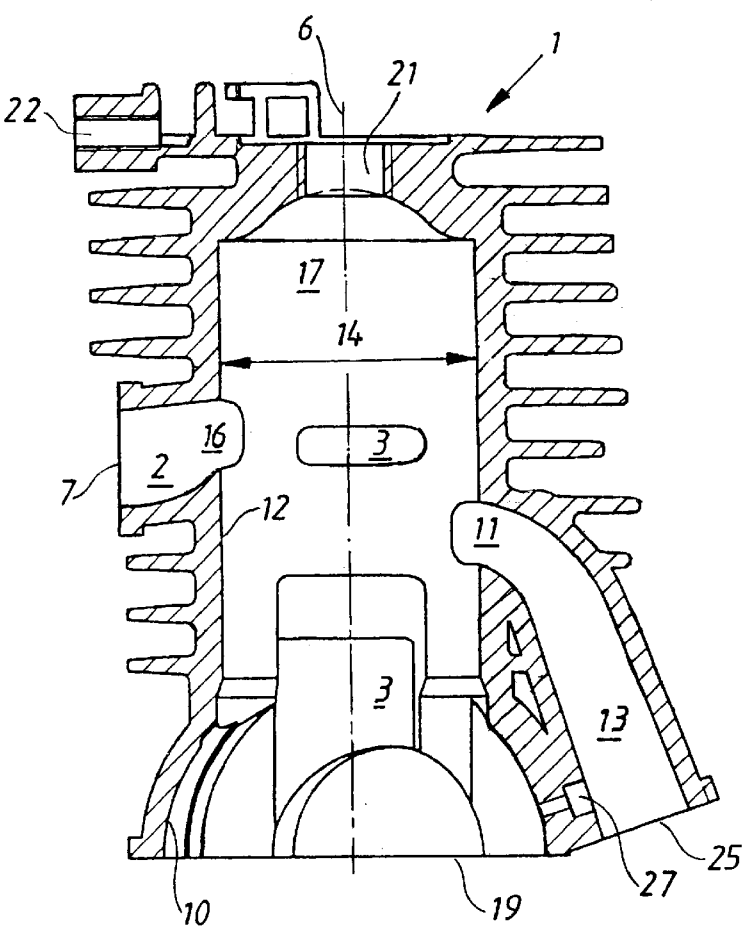
FIG. 2 shows a cross-sectional view through the cylinder in FIG. 1, seen from the side. The cross-section plane is a symmetry plane for inlet duct and exhaust outlet.
Figure 1:
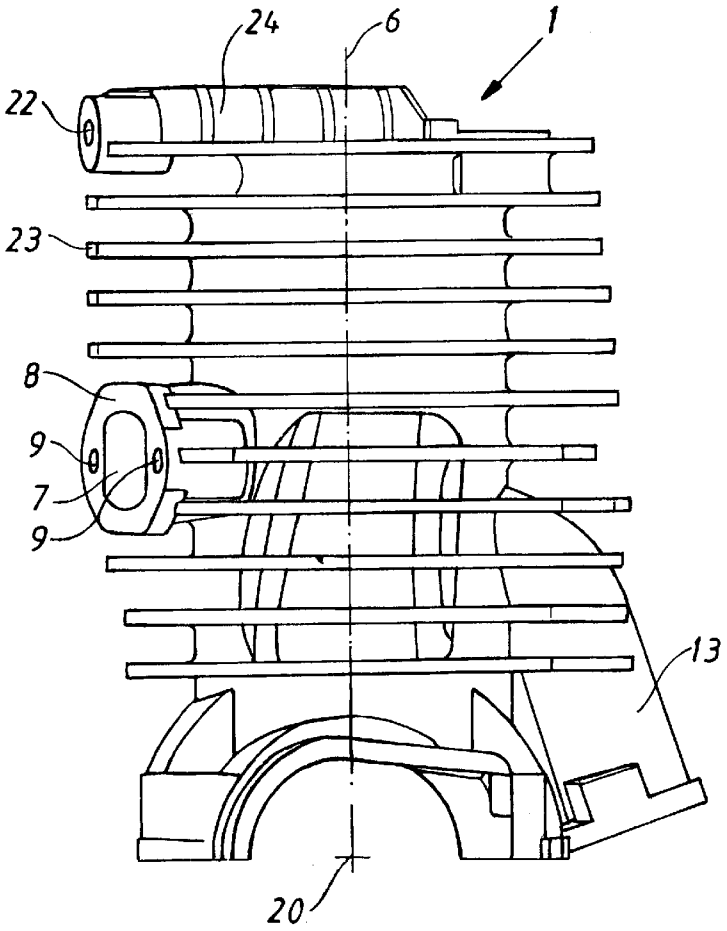
FIG. 1 shows a cylinder in accordance with the subject invention seen from the side in the crankshaft's longitudinal direction, so that inlet duct and exhaust outlet will become apparent.

The cross-section shown in FIG. 2 clearly illustrates inlet duct 13 and exhaust duct 2. The cylinder's exhaust duct 2 and transfer ducts 3, 4 are essentially symmetrically arranged around a mutual symmetry plane 5 which follows the centre line of the cylinder. The cross-section is drawn exactly in this symmetry plane 5. The symmetry plane is in this case not perpendicular towards a plane in the crankshaft's longitudinal direction. This is very characteristic and the difference is here 15 degrees. It means that the transfer ducts 3, 4 debouche somewhat different in the crankcase in comparison with a symmetry plane along the crankshaft. In a chainsaw or trimmer the crankshaft is horizontal when the tool is placed on horizontal ground and thanks to the angular difference the muffler will not end up straight down in the tool when using a horizontal cylinder. In this case the inlet duct 13 is located in the symmetry plane 5, but it could also be turned somewhat around the cylinder's axial centre line 6 in one of the directions. The cylinder's inlet port 11 is located in cylinder wall 12 so that its opening and closing is controlled by the piston. However, it could also be controlled by a so called reed valve and in that case be located in cylinder wall 12 and/or in an adjacent crankcase half 10. The inlet duct 13 has a length, as from the inlet port 11 to its aperture 25, which is longer than 0.8 times the diameter 14, preferably longer than 1.0 times the diameter. Hereby an extremely long preheated part 13 of the total inlet duct used in the engine, is obtained. For, a carburettor or similar can be placed either directly at the aperture 25 or have an intermediate section between itself and the aperture 25.

The inlet duct 13 towards the inlet port 11 differs from a perpendicular direction in relation to the cylinder's axial extension with the centre line 6 and is more directed towards the cylinder's exhaust port 16 and combustion chamber 17. Hereby the inflowing gas will hit the cylinder wall 12 at the exhaust port 16 and turn off up to the cylinder's top section. This creates a cooling effect of the piston and the cylinder wall at the exhaust port, which reduces the risk of engine seizure. In the shown embodiment the inlet duct 13 has a substantial inclination in relation to the centre line, since the cylinder primarily is intended for a tool with a horizontal cylinder. But even at small differences from perpendicular direction a cooling effect is achieved. Normally, inlet ducts incline in the direction of the crankcase, i.e. in an opposite angular direction. In the shown embodiment the inlet duct 13 has such a direction and such a large length that it reaches down to the area of the cylinder's crankshaft centre 19, and the upper crankcase half 10 is integrated in the cylinder, i.e. cast in one piece. A parting plane 19 is embodied where the bottom crankcase half is mounted to the upper one. Obviously, the parting plane can differ somewhat from the intended crankshaft centre with the centre line 20. Also the aperture 25 of the inlet duct 13 has a parting plane or mounting plane and this associates with the parting plane 19. As mentioned, inlet duct and cylinder are cast in one piece, and the inlet duct associates with the upper crankcase half 10. Obviously this creates a satisfactory heat transmission and an extremely good mechanical stability of the inlet duct. However, in other applications it is conceivable to have an inlet duct which stands out more straight from the cylinder body, and, it is also conceivable to use a cylinder without the integrated crankcase half 10. In FIG. 2 is shown a connection 27 embodied in the inlet duct 13. It connects the inlet duct 13 with the crankcase in such a manner that fuel drops can flow from the inlet duct to the crankcase. Hereby a certain improvement of the idling can be achieved. Preferably the connection has a collecting part, which debouches in the wall of the inlet duct 13, having a diameter of approximately 3 mm, and another part, which debouches in the crankcase, having a smaller diameter, approximately 1 mm. A placing of the connection 27 adjacent the aperture 25 of the inlet duct 13 will make it easy to drill the holes through the aperture 25.

Figure 3:
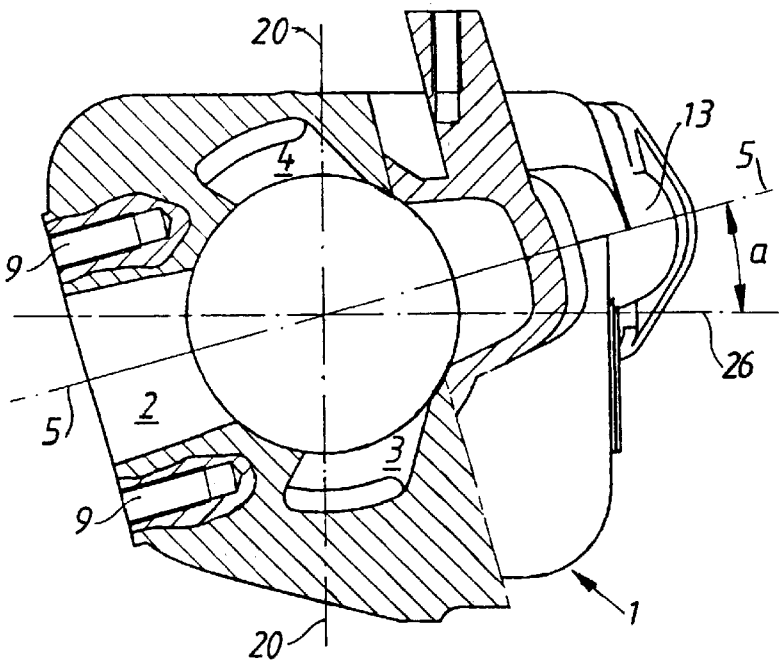
FIG. 3 shows a cross-sectional view through the cylinder perpendicularly towards its longitudinal centre line and seen downwards to the crankcase. The cross-section is made at two different heights of the cylinder in order to show the cylinder, on the one hand at the exhaust port, and on the other hand at the inlet port.

FIG. 3 shows a transverse cross-sectional view through the cylinder. It here becomes apparent that exhaust duct 2 and transfer ducts 3, 4, as well as inlet duct 13, are symmetrically arranged around the symmetry plane 5. The crankshaft's centre line 20 is marked, as well as a line 26, which is perpendicular in relation to the crankshaft's centre line. The symmetry plane 5 differs from perpendicular orientation 26 by an angle $\alpha$ in relation to the cylinder's crankshaft centre line 20. The angle $\alpha$ is larger than 0 degrees but smaller than 30 degrees. Preferably the angle $\alpha$ is approximately 15 degrees.

Figure 4:
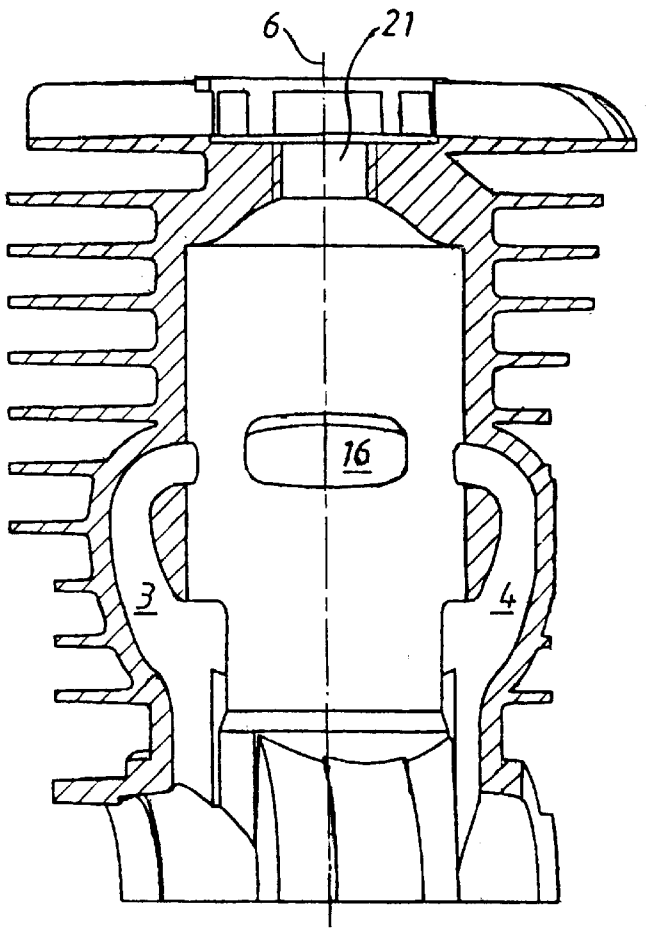
FIG. 4 is a cross-sectional view through the cylinder seen from the side but perpendicularly in relation to the cross-sectional view in FIG. 2. In this manner the transfer ducts will become apparent.

FIG. 4 is a cross-sectional view along the symmetry plane 5. The transfer ducts 3, 4, as well as exhaust port 16, will become apparent in the figure. Furthermore it becomes apparent that the cylinder has a threaded mounting hole 21, intended for a spark plug. The mounting hole 21 is concentric with the centre line 6 of the cylinder.

What is claimed is:

1. A cylinder (1) for a two-stroke internal combustion engine intended for a handheld working tool, wherein an exhaust duct (2) and transfer ducts (3, 4) of the cylinder are arranged essentially symmetrically around a mutual symmetry plane (5) which follows a center line (6) of the cylinder, and at a mouth (7) of the exhaust duct (2) outside the cylinder, a mounting plane (8) with mounting holes (9) for a directly mounted muffler, is arranged, wherein at least one inlet port (11) is located in the cylinder wall (12), and wherein a cylinder inlet duct (13) towards the inlet port (11) is arranged to form a fixed heat-conducting part of the cylinder and has a length longer than 0.8 times the diameter (14) of the cylinder and wherein the inlet duct (13) directed towards the inlet port (11) differs from a perpendicular direction in relation to the center line (6) of the cylinder and is directed generally more towards the exhaust port (16) and combustion chamber (17) of the cylinder, and by these means the piston and the cylinder wall (12) at the exhaust port (16) is cooled.

2. A cylinder (1) in accordance with claim 1, wherein the inlet duct (13) has a direction and a length such that it reaches down towards the area at the cylinder crankshaft center (19).

3. A cylinder (1) in accordance with claim 1, wherein the inlet duct (13) is produced by casting together with the remaining part of the cylinder.

4. A cylinder (1) in accordance with claim 1, wherein the upper crankcase half (10) is integrated in the cylinder.

5. A cylinder (1) in accordance with claim 4, wherein the symmetry plane (5) differs from perpendicular orientation (26) in relation to the cylinder crankshaft center line (20), with an angle $\alpha$.

6. A cylinder (1) in accordance with claim 5, wherein the angle $\alpha$ is larger than 0° but smaller than 30°.

7. A cylinder (1) in accordance with claim 6 wherein the angle $\alpha$ is approximately 15°.

8. A cylinder (1) in accordance with claim 1, wherein threaded mounting holes (21) for a spark plug are concentric with the center line (6) of the cylinder, and wherein the adjacent upper cooling fins are horizontal, such that they move in an axial direction parallel with the centre line (6).

9. A cylinder (1) in accordance with claim 1, wherein the cylinder is provided with mounting holes (22) for a support holder of the muffler.

10. A cylinder (1) in accordance with claim 1, wherein the fixed heat-conducting part of the cylinder has a length longer than 1.0 times the diameter (14) of the cylinder.

* * * * *

UNITED STATES PATENT AND TRADEMARK OFFICE

CERTIFICATE OF CORRECTION

PATENT NO. : 6,161,509
DATED : December 19, 2000
INVENTOR(S) : Dahlberg et al.

It is certified that error appears in the above-identified patent and that said Letters Patent is hereby corrected as shown below:

Column 4, claim 1,
Line 35, delete "more".

Signed and Sealed this

Tenth Day of July, 2001

*Attest:*

Nicholas P. Godici

*Attesting Officer*

NICHOLAS P. GODICI
*Acting Director of the United States Patent and Trademark Office*